US007618234B2

(12) United States Patent
Brackett et al.

(10) Patent No.: US 7,618,234 B2
(45) Date of Patent: Nov. 17, 2009

(54) HOOK RING SEGMENT FOR A COMPRESSOR VANE

(75) Inventors: James G. Brackett, Palm Beach, FL (US); Charles Ellis, Stuart, FL (US); Michael Davis McGhee, Lake Worth, FL (US); J. Page Strohl, Stuart, FL (US)

(73) Assignee: Power System Manufacturing, LLC, Jupiter, FL (US)

( * ) Notice: Subject to any disclaimer, the term of this patent is extended or adjusted under 35 U.S.C. 154(b) by 453 days.

(21) Appl. No.: 11/674,731

(22) Filed: Feb. 14, 2007

(65) Prior Publication Data

US 2008/0193290 A1 Aug. 14, 2008

(51) Int. Cl.
*F01D 9/04* (2006.01)

(52) U.S. Cl. ..... 415/119; 415/191; 415/208.1; 415/208.2; 415/209.2; 415/209.3; 29/889.22

(58) Field of Classification Search ..... 415/119, 415/191, 208.1, 208.2, 209.2, 209.3, 209.4, 415/210.1; 416/190, 191, 192, 248, 500; 29/889.22

See application file for complete search history.

(56) References Cited

U.S. PATENT DOCUMENTS 2,812,159 A * 11/1957 Krebs ..... 415/119
3,326,523 A * 6/1967 Bobo ..... 415/209.3
3,849,023 A * 11/1974 Klompas ..... 415/173.7
4,014,627 A * 3/1977 Heurteux ..... 415/189
5,022,818 A * 6/1991 Scalzo ..... 415/209.3
5,195,868 A * 3/1993 Plemmons et al. ..... 415/177
5,846,050 A * 12/1998 Schilling ..... 415/135
6,984,108 B2 1/2006 Anderson et al.
7,024,744 B2 * 4/2006 Martin et al. ..... 29/401.1

* cited by examiner

*Primary Examiner*—Igor Kershteyn
(74) *Attorney, Agent, or Firm*—Shook, Hardy & Bacon LLP

(57) ABSTRACT

Embodiments for a compressor stator vane assembly in a gas turbine engine are disclosed. In an embodiment of the present invention a stator vane assembly is provided having a plurality of vanes each with an attachment and channels machined into the forward and aft walls of the attachment. A forward hook ring segment is pressfit into the channel in the forward wall of the attachment and an aft hook ring is pressfit into the channel in the aft wall of the attachment. The hook ring segments join a plurality of vanes together so as to provide a uniform engagement of mounting slots in the compressor case. Such an arrangement increases the contact area between the hook rings and the compressor case such that damping of individual vane vibrations are improved and operating stresses are reduced.

20 Claims, 6 Drawing Sheets

HOOK RING SEGMENT FOR A COMPRESSOR VANE

CROSS-REFERENCE TO RELATED APPLICATIONS

Not Applicable.

STATEMENT REGARDING FEDERALLY SPONSORED RESEARCH OR DEVELOPMENT

Not Applicable.

TECHNICAL FIELD

The present invention relates to gas turbine engines. More particularly, embodiments of the present invention relate to a stator vane assembly for use in a compressor of a gas turbine engine.

BACKGROUND OF THE INVENTION

Gas turbine engines are typically utilized to provide thrust to an aerial vehicle or mechanical power to drive an electrical generator. Gas turbine engines comprise at least a compressor, a combustion system, and a turbine, with the turbine coupled to the compressor through a shaft.

A typical compressor comprises a plurality of axially spaced and alternating rows of rotating and stationary airfoils. The rotating airfoils in the compressor are commonly referred to as blades and stationary airfoils are referred to as vanes or stators. Each stage of the blades and vanes decrease in radial height through the compressor as the volume of space decreases. As a result, the air compresses and pressure increases through each stage. The vanes serve to redirect the airflow onto the next stage of blades at the correct incidence angle.

Compressor vanes have an attachment for mounting the individual vanes in the compressor casing. The compressor blades are mounted by an attachment to the rotor while the compressor vanes are mounted by an attachment to the compressor casing. This configuration can be better understood with reference to FIG. 1, which depicts a portion of a typical gas turbine engine in cross section. The engine 10 includes an inlet 12, a compressor 14, a plurality of can-annular combustors 16, a turbine 18, a diffuser 20, and a shaft 22 (not shown) that lies generally coaxial to a centerline A-A. A closer, more detailed view of the compressor section 14 is shown in FIG. 2.

FIG. 2 depicts a series of alternating rows of blades 24 and vanes 26. The blades 24 are attached to a disk 28 and extend radially outward towards a compressor case 30 whereas the vanes 26 are attached to the compressor case 30 and extend radially inward towards the centerline A-A.

An example of a prior art compressor vane 26 used in the compressor 14 is shown in FIG. 3. The compressor vane 26 in FIG. 3 includes two straight hooks 32 located as part of the attachment 34 for mounting the vane 26 in the compressor case 30. However, the compressor case 30 is annular in shape and the slots 36 extend circumferentially about the case. Therefore, with the vane 26 having straight hooks 32 and the vanes being placed into circumferential slots 36 in the case, the hooks did not sit completely flush in the slots 36, and as a result a concentrated load occurs at the ends of the hooks 32.

This straight hook configuration is ideal for manufacturing due to its simple machining techniques and set-up required. Since all surfaces are straight and perpendicular, each vane can be individually machined. However, this arrangement is not ideal for engine operation due to the mismatch between the hooks and slots and the high localized stress that occurs due to this mismatch. As a result of this configuration the compressor vanes vibrate and rattle during engine operation. Any damping that does occur for this design is limited due to the stators being individual (low mass/low inertia) and having limited contact area with the slots for reacting displacement forces. As a result of the increased stress and limited damping, significant wear is exhibited at the compressor vane attachment hooks as well in the circumferential slot of the case. This wear requires premature replacement of the vanes and repair to the case.

SUMMARY OF THE INVENTION

The present invention provides embodiments for a compressor stator vane assembly in a gas turbine engine that addresses the limited damping capability of the prior art vane configuration. In an embodiment of the present invention a stator vane assembly is provided having a plurality of vanes, each vane having an attachment and channels machined into forward and aft walls of the attachment. A forward hook ring segment is pressfit into the channel in the forward wall of the attachment and an aft hook ring segment is pressfit into the channel in the aft wall of the attachment. The hook ring segments in turn engage the grooves in the compressor case, such that the contact area between the hook rings and the compressor case are significantly improved.

In an alternate embodiment, a method of forming a compressor vane assembly is disclosed. The method disclosed provides a means for assembling a plurality of vanes together with a forward hook ring segment pressfit into a channel in the forward face of the attachment and an aft hook ring segment pressfit into a channel in the aft face of the attachment.

In a further embodiment, a method of modifying prior art individual vanes into a compressor stator vane assembly is provided. The method utilizes modifying existing individual vanes having a pair of straight hooks to provide a channel in the forward face of the attachment and a channel in the aft face of the attachment. The method further comprises placing a forward hook ring segment into the channel and an aft hook ring segment into the channel such that each of the hook ring segments are pressfit into the attachment of the vanes to form a vane assembly.

Additional advantages and features of the present invention will be set forth in part in a description which follows, and in part will become apparent to those skilled in the art upon examination of the following, or may be learned from practice of the invention.

BRIEF DESCRIPTION OF THE SEVERAL VIEWS OF THE DRAWING

The present invention is described in detail below with reference to the attached drawing figures, wherein.

DETAILED DESCRIPTION OF THE INVENTION

Figure 1:
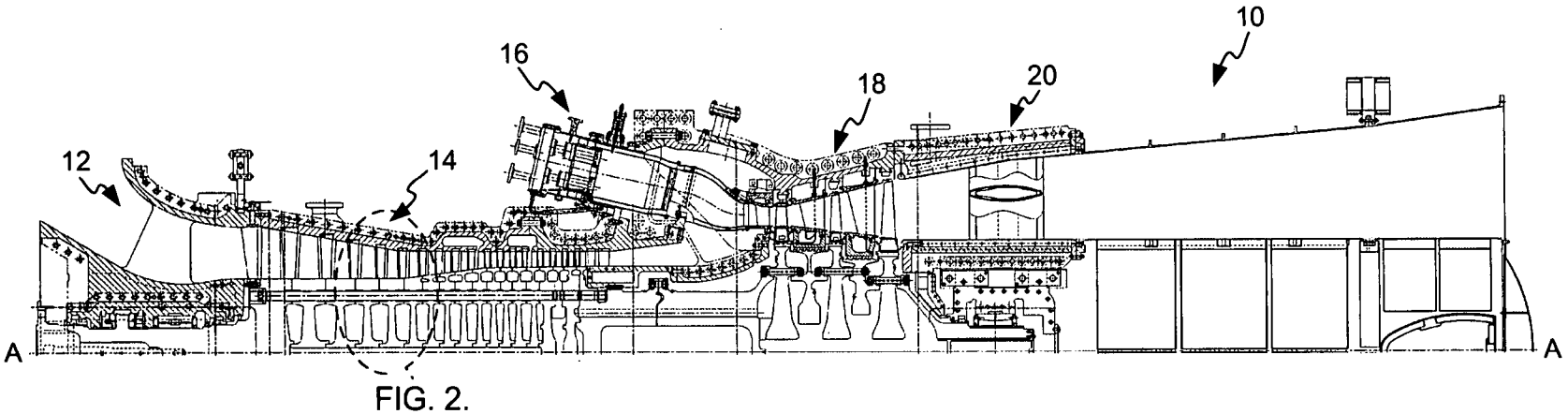
FIG. 1. PRIOR ART
FIG. 1 depicts a partial cross section view of a typical gas turbine engine of the prior art.
Figure 2:
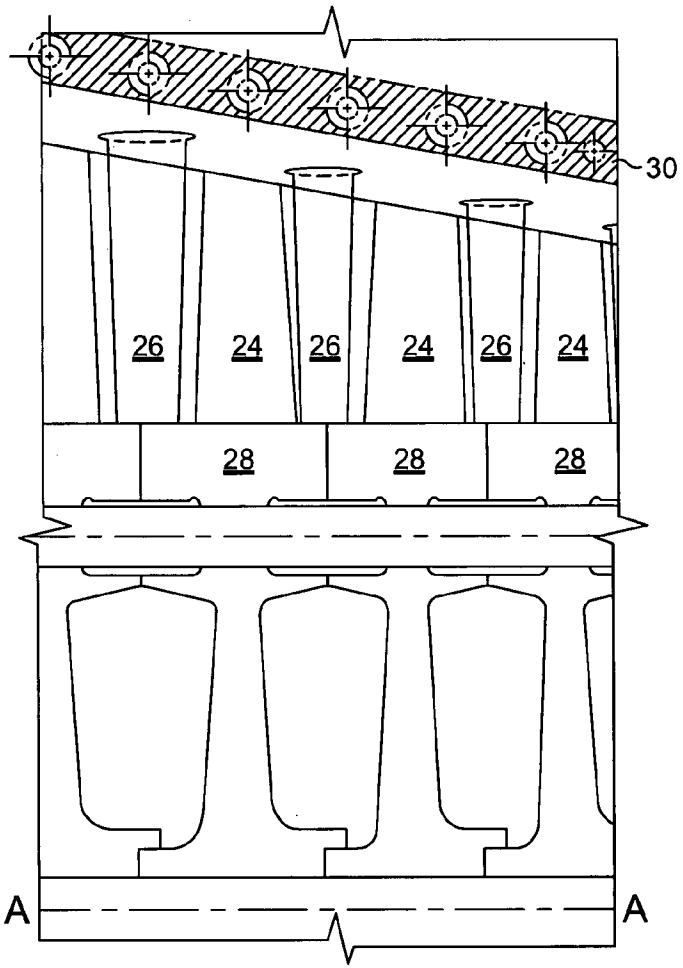
FIG. 2. PRIOR ART
FIG. 2 depicts a partial cross section view of a portion of the compressor of the prior art.

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" may be used herein to connote different elements of methods employed, the terms should not be interpreted as implying any particular order among or between various steps herein disclosed unless and except when the order of individual steps is explicitly described.

Referring now to FIGS. 4-7, the present invention provides a vane assembly 50 for reducing operating stresses and vibrations in individual vanes. The vane assembly of the present invention comprises a plurality of vanes 52, each vane having an airfoil 54 and an attachment 56. The attachment 56 has a first surface 58 adjacent the airfoil 54 and a second surface 60 spaced a distance from the first surface. In the embodiment shown in FIGS. 4-7, the first surface 58 is generally parallel to the second surface 60. However, depending on the actual attachment geometry, these surfaces could each have a radius of curvature.

Extending between the first surface 58 and the second surface 60 is a pair of generally parallel and axially extending sidewalls 62 and 64 and a forward wall 66 and aft wall 68, with the forward and aft walls 66 and 68 being generally perpendicular to the plurality of sidewalls 62 and 64. Another feature of the attachment 56 is a forward channel 70 in the forward wall 66 and an aft channel 72 in the aft wall 68. As it can be noted from FIG. 6, the forward channel 70 and aft channel 72 both have a general "C" shape cross section. Furthermore, the channels 70 and 72 are generally arc-shaped in the direction along the forward and aft walls such that the channels have a radius of curvature. In addition, the channels 70 and 72 are located at approximately the same radial position along the attachment.

Figure 7:
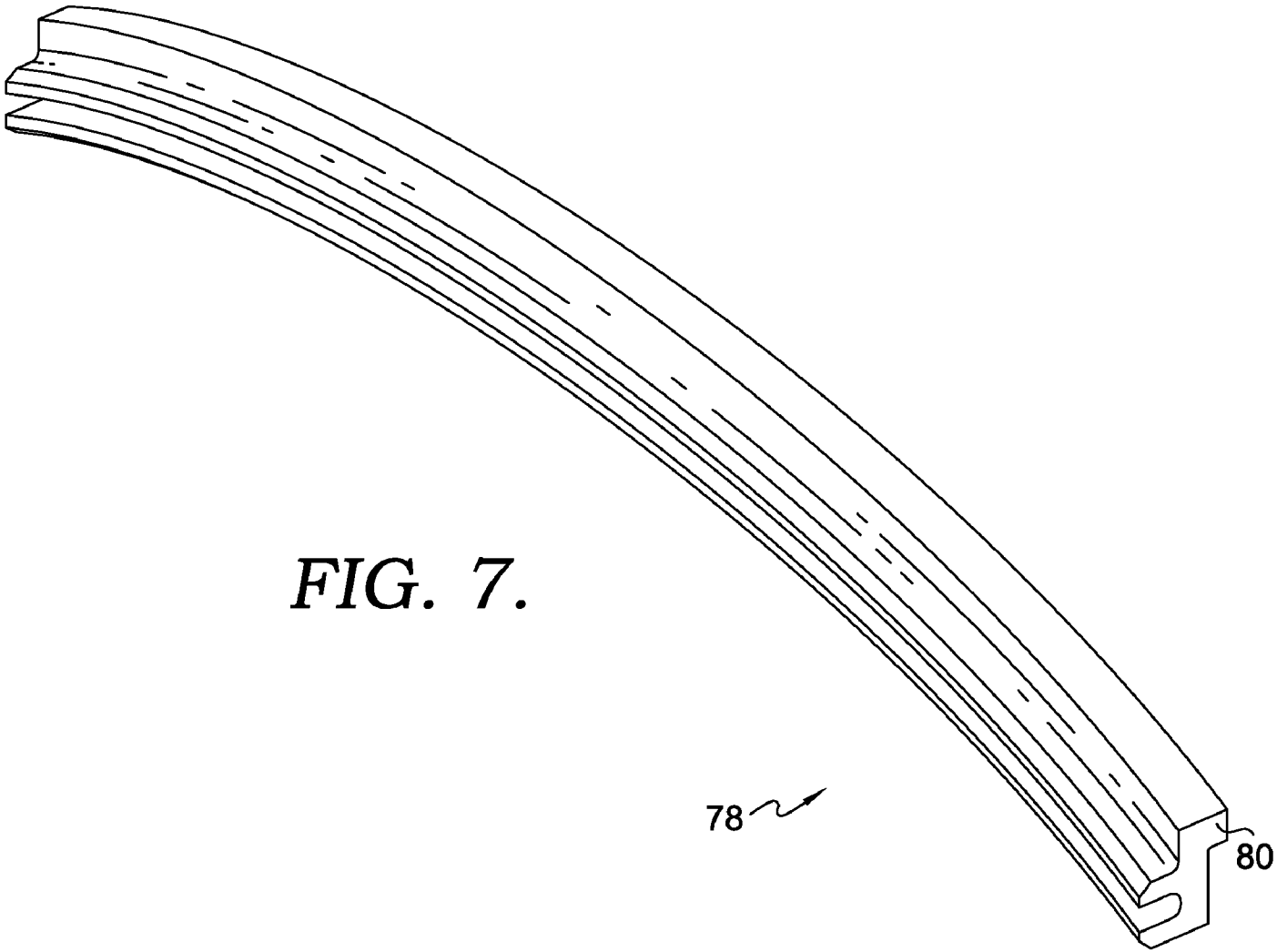
FIG. 7 depicts a perspective view of a hook ring segment in accordance with a preferred embodiment of the present invention.

The vane assembly 50 also comprises a forward hook ring segment 74 which has a circumferential length and an axially extending hook 76 and an aft hook ring segment 78 which also has a circumferential length and an axially extending hook 80. The aft hook ring segment 78 is shown in FIG. 7. The hook ring segments 74 and 78 are used to join the plurality of vanes 52 together into vane assembly 50. This is possible since the hook ring segments are generally arc-shaped with a radius of curvature corresponding to the arc-shaped channels 70 and 72.

In order to join the vanes together, the forward hook ring segment 74 is pressfit into the forward channel 70 and the aft hook ring segment 78 is pressfit into the aft channel 72 of the attachment 56. To assist in the assembly of the hook ring segments 74 and 78 into the attachment, the hook ring segments each have chamfers at approximately a 45 degree angle at the corners of the surfaces that are first inserted into the channels 70 and 72. The outside edges 70*a* and 72*a* of the channels are also chamfered.

As one skilled in the art will understand, a pressfit is a means of binding two or more components together through an interference fit along mating surfaces. The exact amount of interference is a function of the design requirements, component materials, and operating conditions. For an embodiment of the present invention, the radial dimensions of the forward and aft channels 70 and 72, respectively, are slightly undersized compared to the radial height of the forward and aft hook ring segments 74 and 78, respectively. For the embodiment disclosed in FIGS. 4-7, this difference in dimension is set for up to 0.0005 inches of interference between the mating surfaces of the hook ring segment and channel. Such an interference fit was set in order to minimize stresses in the attachments 56 yet provide sufficient retention of vanes 52 in hook ring segments 74 and 78. However, the interference fit could be slightly larger, for example up to about 0.0015 inches without exceeding the material capabilities of the vane attachments. The interference fit also serves to dampen the vibrations in the individual vanes and reduce the amount of displacement that can occur from vane-to-vane during operation.

As previously stated, the hook ring segments join a plurality of vanes together. For the embodiment shown in FIGS. 4-7, the vane assembly 50 comprises five vanes 52 assembled together by hook ring segments 74 and 78. However, the quantity of vanes shown in the vane assembly is meant to be merely illustrative and the actual quantity of vanes can vary depending on the engine configuration.

Depending on the engine conditions and compressor case receiving the vane assemblies, it may be desirable to also apply a coating to the surfaces of the hook ring segments that contact the compressor casing. Specifically, this region is radially inward of the axially extending hooks. Applying a coating, such as an Aluminum Bronze, ensures that the wear between the hook ring segments and the compressor case will be directed towards the hook ring segments, as these components can be replaced easier than repairing the large compressor casing out in the operating field.

Once the vanes are assembled with the hook ring segments into the vane assembly 50, it is ready to be installed in the compressor casing. The vane assembly is held in the casing by the hooks 76 and 80 on the forward hook ring segment and aft hook ring segment respectively. Each vane assembly is intended to abut to an adjacent vane assembly when installed in an engine so as to provide additional damping from assembly to assembly. While it is intended that each vane assembly abuts and adjacent vane assembly, as one skilled in the art will understand, there may be small gaps between adjacent vane assemblies due to manufacturing and/or assembly tolerances. Any gaps that may be present between the vane assemblies are sealed by shim plates.

In an alternate embodiment, a method of forming a compressor stator vane assembly is disclosed in which the method comprises providing a plurality vanes, with each vane having an airfoil 52 and an attachment 56 having a forward wall 66 and an aft wall 68. Each of the forward wall and aft wall have a channel 70 and 72 therein, respectively.

The method also comprises providing a circumferentially extending forward hook ring segment 74 and a circumferentially extending aft hook ring segment 78. The method then comprises a step of inserting the forward hook ring segment 74 into the forward channel 70 and inserting the aft ring segment 78 into the aft channel 72. By inserting the forward and aft hook ring segments into the forward and aft channels, the plurality of vanes are joined together to create a vane assembly with this vane assembly having increased damping capability.

Figure 3:
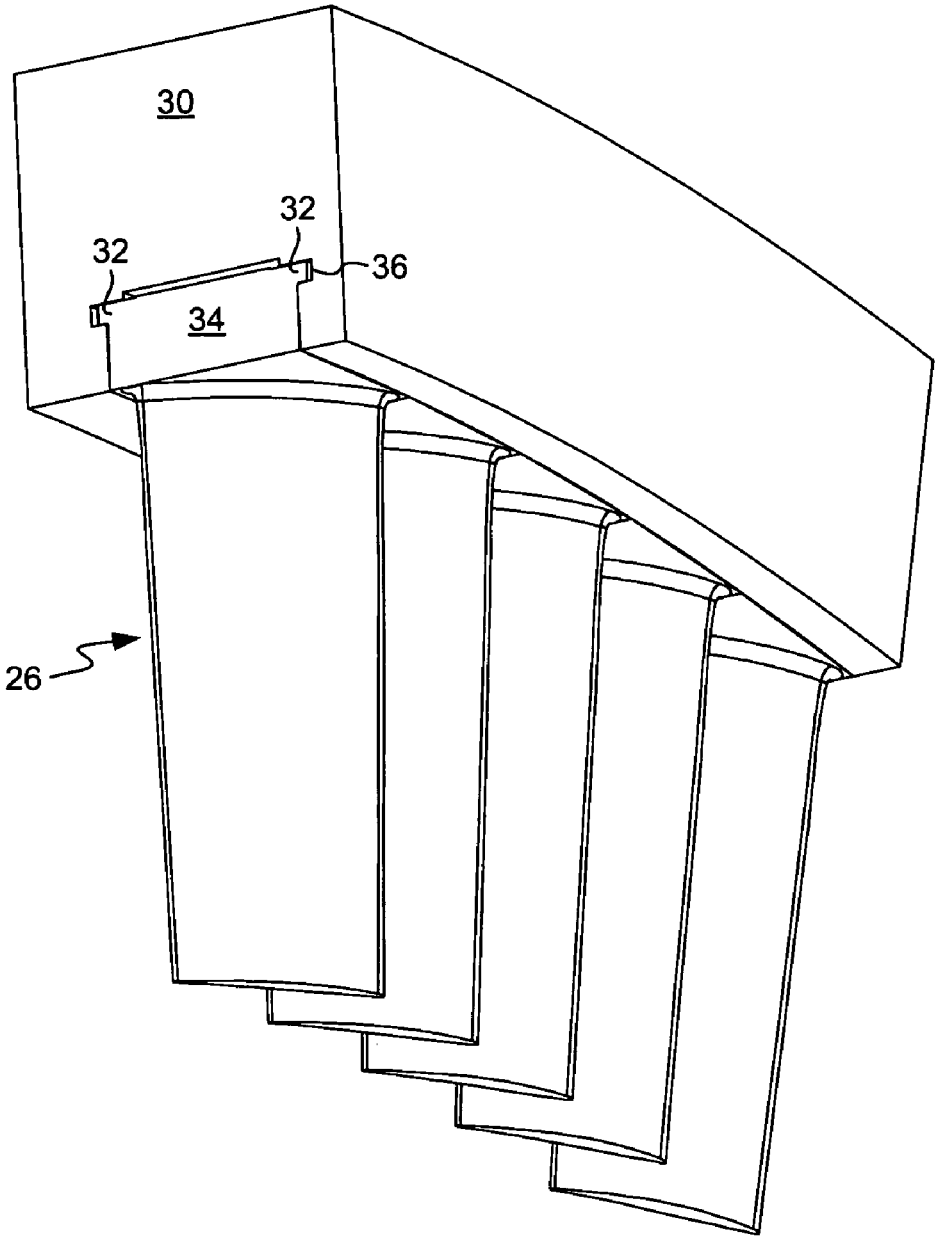
FIG. 3. PRIOR ART
FIG. 3 depicts a perspective view of a series of vanes installed in the case of the prior art.
Figure 4:
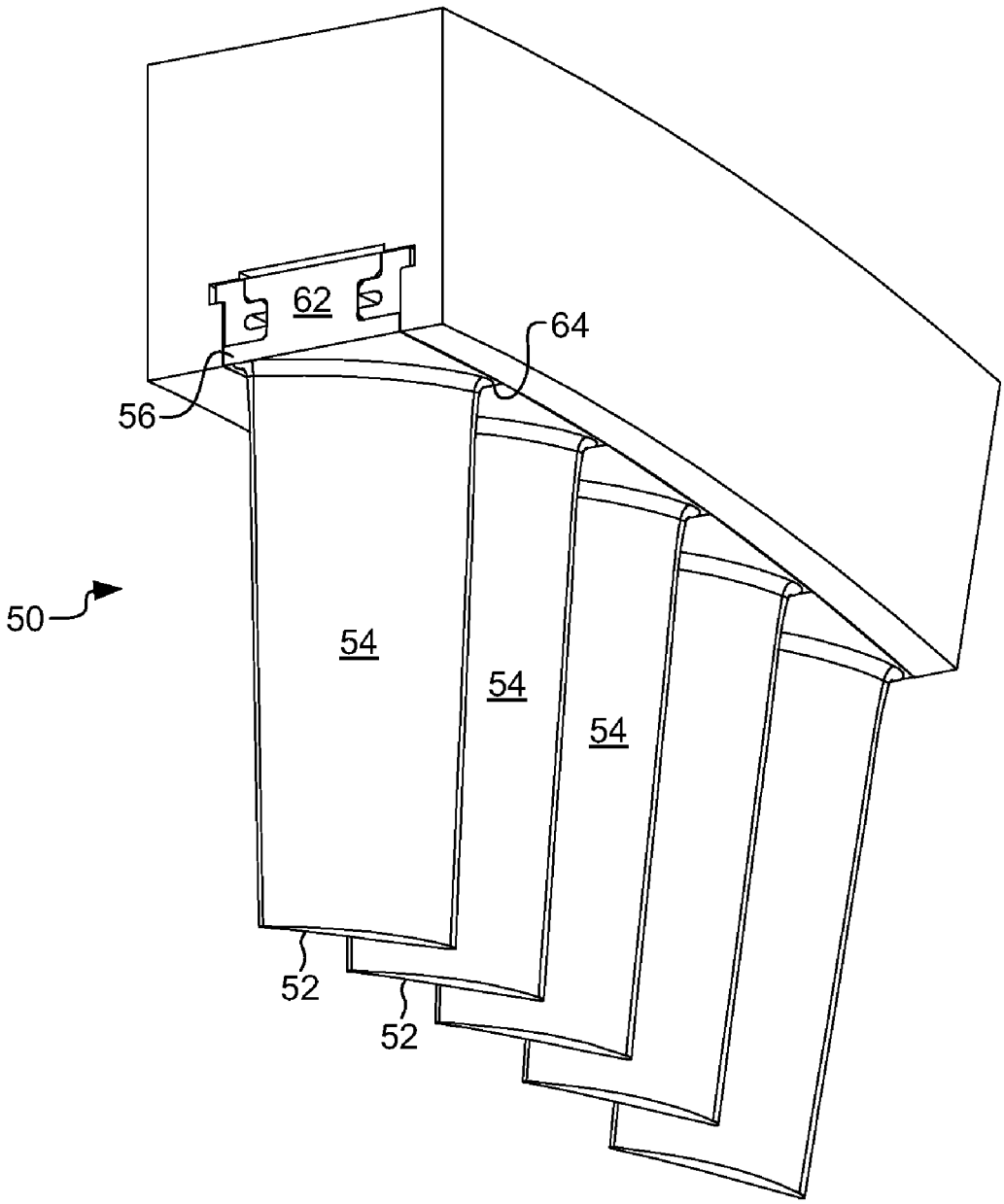
FIG. 4 depicts a perspective view of a vane assembly installed in a case in accordance with a preferred embodiment of the present invention.
Figure 5:
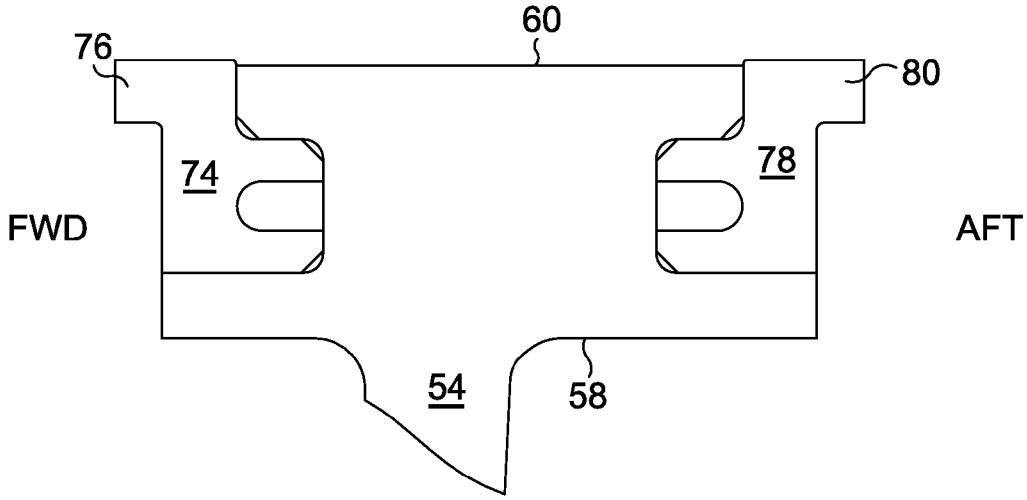
FIG. 5 depicts a partial cross section view of a vane assembly in accordance with a preferred embodiment of the present invention.
Figure 6:
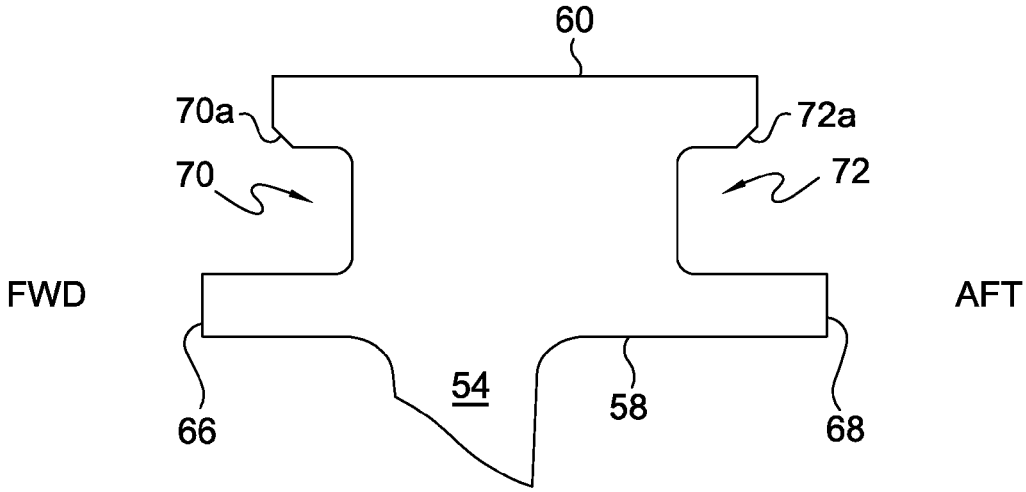
FIG. 6 depicts a partial cross section view of the attachment portion of a vane assembly in accordance with a preferred embodiment of the present invention.

In yet another embodiment of the invention, a method of modifying individual vanes to form a compressor stator vane assembly is disclosed. In this method a plurality of vanes are provided with each vane having an airfoil 52 and an attachment 56 with the attachment having a first surface 58 and a second surface 60 spaced a distance from the first surface 58 and generally parallel thereto. Extending between the first surface 58 and the second surface 60 is a pair of generally parallel sidewalls 62 and 64 and a forward wall 66 and an aft wall 68, with the forward and aft walls and the sidewalls being generally perpendicular to the first surface and second surface. The attachment is also initially provided with forward and aft hooks 32 (see FIG. 3) that are generally parallel to the first and second surfaces.

This method also comprises providing a circumferentially extending forward hook ring segment 74 and a circumferentially extending aft hook ring segment 78. Since this vane assembly is fabricated from existing individual vane segments, the sidewalls 62 and 64 of the attachment are machined at an angle so as to taper the sidewalls and improve surface area contact between adjacent vane sidewalls. This angle is preferably radial, but can also be a compound radial/axial angle. The existing forward and aft hooks 32 are removed by machining a forward channel 70 having a radius of curvature into the forward wall 66 and machining an aft channel 72 having a radius of curvature into an aft wall 68 of the attachment. Once the vane attachment has been modified to remove the original hooks and incorporate the channels, the forward hook ring segment 74 is inserted into the forward channel 70 and the aft hook ring segment 78 is inserted into the aft channel 72. These hook ring segments join together the individual vane segments at their attachment to form a vane assembly.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

What is claimed is:

1. A compressor stator vane assembly comprising:

a plurality of vanes, each vane having an airfoil and an attachment wherein the attachment has a first surface and a second surface spaced a distance from the first surface, extending between the first surface and the second surface is a pair of generally parallel sidewalls and a forward wall and an aft wall, with the forward and aft walls generally perpendicular to the plurality of sidewalls, the forward wall having a forward channel and the aft wall having an aft channel;

a forward hook ring segment having a generally circumferential length and axially extending hook; and an aft hook ring segment having a generally circumferential length and axially extending hook;

wherein the forward hook ring segment and aft hook ring segment are pressfit into the forward channel and aft channel of each vane attachment, respectively, so as to join the plurality of vanes together to form the vane assembly.

2. The vane assembly of claim 1 wherein the first and second surfaces of the attachment are generally parallel.

3. The vane assembly of claim 1 wherein the first and second surfaces of the attachment have a radius of curvature.

4. The vane assembly of claim 1 wherein the forward and aft channels have a generally "C" shaped cross section.

5. The vane assembly of claim 4 wherein the forward and aft channels are generally arc-shaped.

6. The vane assembly of claim 5 wherein the forward and aft hook ring segments are generally arc-shaped.

7. The vane assembly of claim 6 wherein the pressfit of the hook ring segments into the forward and aft channels creates 0.000-0.0005 inches of interference between the hook ring segments and the attachment.

8. The vane assembly of claim 1 wherein the hook ring segments dampen vibrations from the plurality of vanes.

9. The vane assembly of claim 1 comprising five individual vanes.

10. The vane assembly of claim 1 wherein a gap is maintained between adjacent attachments of the plurality of vanes.

11. The vane assembly of claim 1 wherein the forward hook ring segment and aft hook ring segment further comprise an Aluminum Bronze coating applied to a surface of the hook ring segment that contacts a compressor casing.

12. The vane assembly of claim 11 wherein the vane assembly is positioned within the compressor casing by the hooks on the forward hook ring segment and aft hook ring segment.

13. A method of forming a compressor stator vane assembly comprising:

providing a plurality of vanes, each vane having an airfoil and an attachment wherein the attachment has a first surface and a second surface spaced a distance from the first surface, extending between the first surface and the second surface is a pair of generally parallel sidewalls and a forward wall and an aft wall, with the forward and aft walls generally perpendicular to the plurality of sidewalls, the forward wall having a forward channel and the aft wall having an aft channel;

providing a circumferentially extending forward hook ring segment;

providing a circumferentially extending aft hook ring segment; and inserting the forward hook ring segment into the forward channel and inserting the aft hook ring segment into the aft channel.

14. The method of claim 13 wherein inserting the hook ring segments into the channels of the attachment creates 0.000-0.0005 inches of interference between the hook ring segments and the attachment.

15. The method of claim 13 further comprising the step of coating at least one surface of the forward hook ring segment and aft hook ring segment, not in contact with the attachment, with an Aluminum Bronze coating.

16. The method of claim 15 further comprising inserting the vane assembly within a compressor casing by the hooks on the forward hook ring segment and aft hook ring segment.

17. A method of modifying individual vanes into a compressor stator vane assembly comprising:

providing a plurality of vanes, each vane having an airfoil and an attachment wherein the attachment has a first surface and a second surface spaced a distance from the first surface and generally parallel thereto, extending between the first surface and the second surface is a pair of generally parallel sidewalls and a forward wall and an aft wall, with the forward and aft walls and the side walls being generally perpendicular to the first surface and second surface, and having a forward hook and an aft hook that are generally parallel to the first and second surfaces;

providing a circumferentially extending forward hook ring segment;

providing a circumferentially extending aft hook ring segment;

machining the sidewalls of the attachment such that the sidewalls are oriented at an angle relative to the second surface, and removing the forward hook and aft hook by machining a forward channel having a radius of curvature into the forward wall and machining an aft channel having a radius of curvature into an aft wall; and inserting the forward hook ring segment into the forward channel and the aft hook ring segment into the aft channel.

18. The method of claim 17 wherein inserting the hook ring segments into the channels of the attachment creates 0.000-0.0005 inches of interference between the hook ring segments and the attachment.

19. The method of claim 17 further comprising the step of coating at least one surface of the forward hook ring segment and aft hook ring segment, not in contact with the attachment, with an Aluminum Bronze coating.

20. The method of claim 17 further comprising inserting the vane assembly within a compressor casing by the hooks on the forward hook ring segment and aft hook ring segment.

* * * * *